United States Patent [19]

Joseph

[11] 4,043,476

[45] Aug. 23, 1977

[54] LOCKING DEVICE FOR GOODS TRANSPORTING CARTS AND LIKE RECEPTACLES

[75] Inventor: Raymond Joseph, Schiltigheim, France

[73] Assignee: Ateliers Reunis Societe Anonyme, Schiltigheim, France

[21] Appl. No.: 739,342

[22] Filed: Nov. 5, 1976

[30] Foreign Application Priority Data

Mar. 1, 1976 France ..... 76.05745

[51] Int. Cl.[2] ..... B65D 7/20; B65D 7/32; E05C 5/02; E05C 1/10

[52] U.S. Cl. ..... 220/19; 220/7; 220/324; 292/59; 292/162; 292/152

[58] Field of Search ..... 220/19, 1.5, 6, 7, 25 H, 220/318, 323, 324; 292/59, 147, 152, 162; 206/513

[56] References Cited

U.S. PATENT DOCUMENTS

| | | | |
|---|---|---|---|
| 2,635,786 | 4/1953 | Wickson | 220/19 |
| 2,780,381 | 2/1957 | Coit, Jr. | 220/19 X |
| 3,970,209 | 7/1976 | Baxter | 220/6 |
| 3,979,006 | 9/1976 | Jurasek | 220/19 |

*Primary Examiner*—William Price
*Assistant Examiner*—Steven M. Pollard
*Attorney, Agent, or Firm*—Michael J. Striker

[57] ABSTRACT

In a goods transporting or handling receptacle or cart made of metal wire, the lateral walls are adapted to be folded on the bottom thereof and at least one of said lateral walls comprises a notch-like aperture having a shutter hingedly mounted at its bottom edge. Mounted on each side of said one wall is a locking device comprising a sliding bolt engaging a pair of lugs carried by a carrier plate rigid wth said one wall side and formed with a shoulder portion acting as a keeper to said sliding bolt.

A resilient clamp is adapted to be engaged by a control member rigid with said sliding bolt for holding the latter either in an intermediate position, in which said shutter is locked in its closed position and said one wall is locked with respect to the adjacent lateral wall, or in a first end position in which said sliding bolt is released from said shutter to permit the opening thereof, or in another end position in which said sliding bolt is released from said adjacent wall.

6 Claims, 7 Drawing Figures

LOCKING DEVICE FOR GOODS TRANSPORTING CARTS AND LIKE RECEPTACLES

BACKGROUND OF THE INVENTION

1. Field of the Invention

The present invention relates in general to sliding-bolt locking devices or like means fitted to the walls of certain goods handling receptacles or transport carts or the like, wherein the sliding bolt proper is adapted to lock in their closed position the hinged, drop- or folding shutters provided on said walls.

2. Description of the Prior Art

In fact, certain goods handling receptacles and transport carts comprise on at least one of their walls a relatively wide opening or cut-out portion closed by a hinged shutter, door, flap or the like adapted to be folded down to its open position. This arrangement facilitates greatly the access to the inner space of the corresponding receptacle or cart for discharging same. An arrangement of this kind is also contemplated on certain materials or goods handling receptacles containing loose goods or materials, which are put at the disposal of customers in self-sevice shops and the like. Thus, opening the folding shutter will facilitate the discharge of articles contained in the receptacles or cart by the customer.

Now, carts or receptacles of this type comprise as a rule locking means for keeping the hinged shutter in its closed position during the transport or handling operations. However, certain carts or receptacles of this kind comprise hinged walls adapted to be folded, for example when it is necessry to return or deliver the empty carts or receptacles. In such instances the locking means contemplated on the wall of a cart or receptacle of this type must be capable at the same time to lock the movable shutter in its closed position and to keep the corresponding wall in its upright position.

However, most of the hitherto known locking devices proposed for performing this dual function are not fully satisfactory. Their main inconvenience is that they are not capable of efficiently locking the hinged movable shutter of which the retaining hooks are liable to be released from the corresponding straps or keepers, notably in case of shocks or jolts, or also in case the assembly is turned upside down for discharging its content.

DESCRIPTION OF THE INVENTION

It is therefore the essential object of the present invention to provide a locking device adapted to perform the above-mentioned dual function while positively and reliably locking the folding shutter in its closed position. For this purpose, this device comprises a lock bolt slidably mounted on one side of the movable wall comprising or incorporating said hinged shutter, so that said bolt can either engage a keeper carried by the adjacent wall, or catch said adjacent wall. However, this device is characterised in that, in its intermediate position, said sliding bolt is capable of holding against movement the three members involved, and that a resilient clamp is provided for receiving in this position the bolt control member, said movable shutter further comprising a shoulder or edge engageable by the corresponding end of the bolt, thus preventing any untimely release thereof, even when the cart or receptacle is turned upside down.

Other features and advantages of this locking device will appear as the following description proceeds with reference to a typical emodiment of this locking device intended more particularly for a goods transporting receptacle, this description being given by way of example only.

DESCRIPTION OF THE PREFERRED EMBODIMENTS

Figure 1:
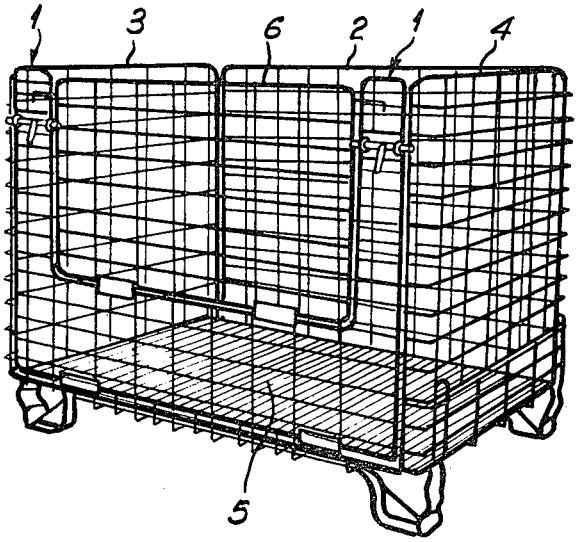
FIG. 1 is a perspective view of the receptacle comprising two locking devices according to this invention, adapted to lock one of its movable walls together with a folding shutter mounted on said one wall.

The lateral wall of the receptacle illustrated in FIG. 1 comprises four walls or panels 1, 2, 3 and 4 hingedly mounted along their bottom edges to the corresponding edges of a horizontal platform 5 constituting the bottom of the receptacle. Thus, said four walls or panels can be folded against said platform 5 when the receptacle is empty. One of the lateral walls, in this case wall 1, comprises at its upper portion a relatively wide aperture in which a movable shutter 6 is hingedly mounted and adapted to be folded outwardly on said wall 1 to facilitate the access to the inner space of the receptacle.

The two lateral sides of the aperture provided with said folding shutter 6 consist each of a pair of arms 6, 7 of a metal upright 9 made from bent wire stock, the lower edge 10 of the aperture consisting of a wire section interconnecting the arms 8 of the pair of lateral uprights 9. The folding shutter 6 consists of a metal grid or grate and has its bottom edge hingedly mounted to the lower edge 10 of the corresponding aperture by means of a pair of elongated metal rings 11.

This hinged mounting is such that the shutter 6 can be lifted in the direction of the arrow F so that it can subsequently be pivoted outwardly on the front of wall 1. In fact, this shutter 6 comprises hook means 12 engaging retaining staples 13 carried by said lateral uprights 9. Therefore, the aforesaid upward movement of shutter 6 is necessary for releasing the hook means 12 from said straps 13 and subsequently pivoting the shutter outwardly.

A locking device designated in general by the reference numeral 14 is provided on each lateral upright 9 of the movable panel 1. Each locking device comprises a horizontal sliding bolt 15 mounted in guide lugs 16 carried by a vertical plate 17 welded to the pair of arms 7 and 8 of the upright 9 concerned. This bolt 15 is adapted to be actuated by means of a small hand lever 18 rigid therewith.

Adjacent the corresponding lateral wall 3, said small plate 17 comprises an integral lip 19 bent at right angles outwardly and adapted to fit around the adjacent upright 20 of said wall. Now, this lip has a hole formed therethrough which constitutes a keeper adapted to be engaged by the corresponding end of sliding bolt 15 when the latter is in one of the two positions illustrated in FIGS. 2 and 3.

Figures 2, 3, 4, 5:
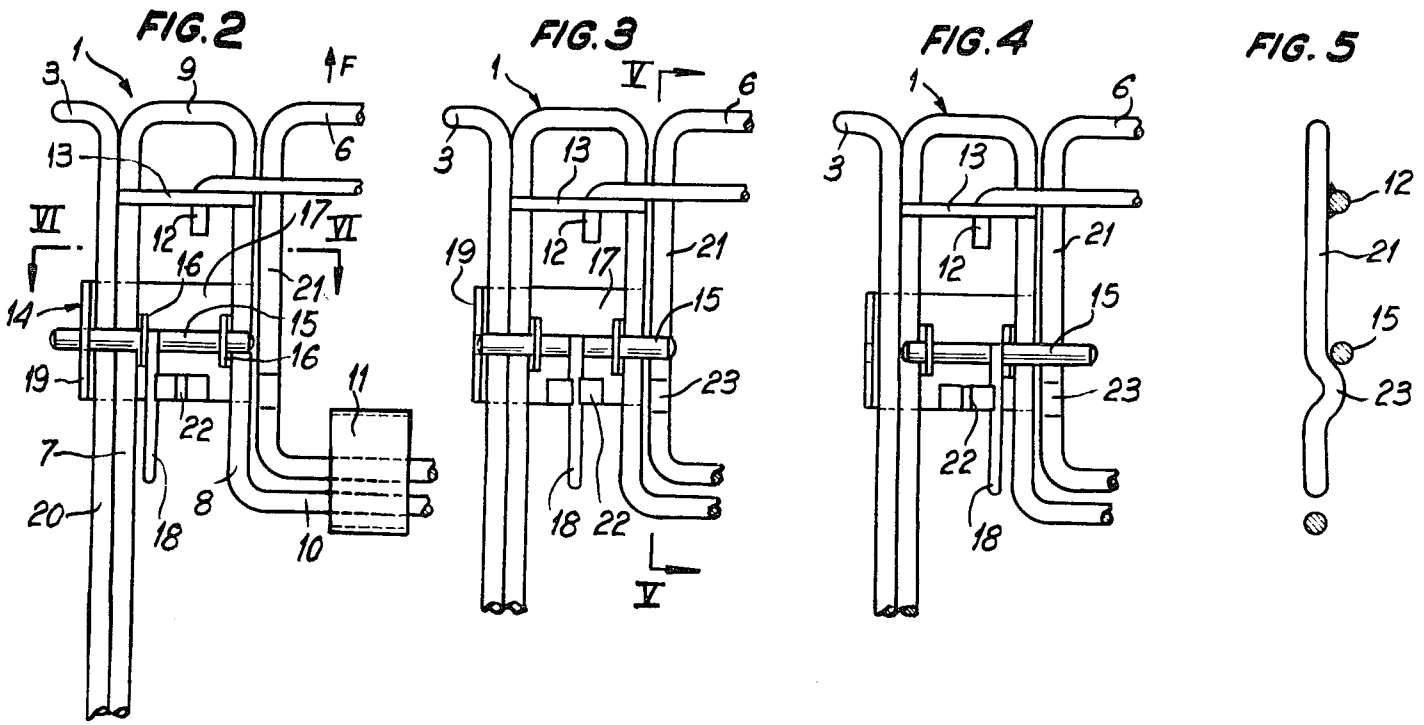
FIG. 2 is a front elevational view of one of the locking devices of FIG. 1, shown in its endmost position corresponding to the locked condition of the movable wall permitting nevertheless the free movements of the corresponding folding shutter.
FIG. 3 is a similar view showing the same device in its intermediate position, in which the movable wall is locked in relation to the adjacent wall and the folding shutter is locked in its closed position.
FIG. 4 is a similar view showing the same device in its opposite end position in which the folding shutter is locked in relation to the relevant movable wall while permitting the free movements of this wall.
FIG. 5 is a fragmentary section taken along the line V—V of FIG. 3.

The length of sliding bolt 15 is such that in its intermediate position illustrated in FIG. 3 its opposite ends lie the one inside the keeper 19 and the other in front of the corresponding upright 21 of folding shutter 6.

Figure 6:
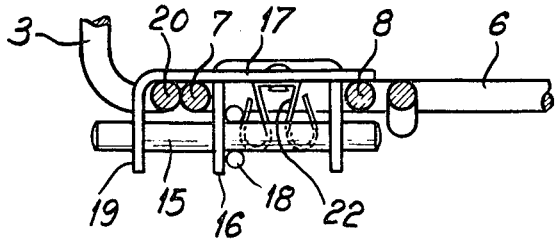
FIG. 6 is a fragmentary section taken along the line VI—VI of FIG. 2.

Besides, the plate 17 is provided with an elastic clamp 22 adapted to receive the bolt control lever 18 when the bolt is in its intermediate position illustrated in FIG. 3. This clamp 22 comprises a metal blade bent to a substantially U-shaped configuration, with the edges bent backwards as illustrated in FIG. 6. Finally, it will be seen that each lateral upright 21 of folding shutter 6 comprises a shoulder disposed just beneath the end of bolt 15 when said end is located in front of said upright. As illustrated in FIG. 5, this shoulder may advantageously consist of an elbow 23 formed integrally with the corresponding upright.

The above-described locking device operates as follows:

In the position illustrated in FIG. 2, the lock or sliding bolt interlocks the wall panel 1 and the adjacent wall panel 3 in their operative or raised position. In fact, this bolt 15 has then one end engaged in keeper 19 and its opposite end extends somewhat short of the adjacent lateral upright 21 of folding shutter 6, so that the latter can be operated freely.

It will be seen that in this position the control lever 18 is disposed between one of the ends of the resilient clamp 22 and one of the lock-bolt guide lugs 16. Thus, the bolt is safely held against movement in this position and prevented from moving untimely in case of shocks or jolts.

In the intermediate position illustrated in FIG. 3 the sliding bolt 15 locks the wall 1 in its upstanding position and simultaneously the shutter 6 in its closed position. In fact, one end of this bolt 15 is still engaged in the keeper 19 while the opposite end now registers with the upright 21 of shutter 6. Therefore, the shutter 6 is positively locked in its closed position.

However, it will be seen that the corresponding end portion of the locking or sliding bolt 15 overlies the shoulder 23 (FIG. 5). Consequently, the shutter 6 cannot be lifted untimely as a consequence of schocks or jolts, which otherwise would have caused the retaining hooks 12 to be released. It will also be seen that in this position the control lever 18 is engaged within the resilient retaining clamp 22 so that the bolt itself is held against movement.

Thus, a double safety feature is obtained which precludes any untimely opening of shutter 6 during transport or handling operations, even if relatively severe shocks are applied to the receptacle. Besides, this double safety feature permits of discharging the receptacle's contents, if necessary, by turning same upside down. Now, this mode of discharging receptacles equipped with hitherto known types of locking devices was not applicable for in this case the folding shutter or shutters provided on certain walls of the receptacle tended to move downwardly by gravity, thus releasing the retaining hooks 12. Consequently, this constitutes another essential advantageous feature of the present locking device.

Finally, in the endmost position illustrated in FIG. 4 the sliding bolt 15 locks the shutter 6 in relation to the wall 1 while permitting the free movement of this wall 1 in relation to the adjacent side wall 3. In fact, the sliding bolt 15 is now disengaged from the keeper 19 and therefore the wall 1 can be folded bodily with the shutter 6 against the bottom 5 of the receptacle, the device of this invention then holding these two elements in mutual locking relationship.

Figure 7:
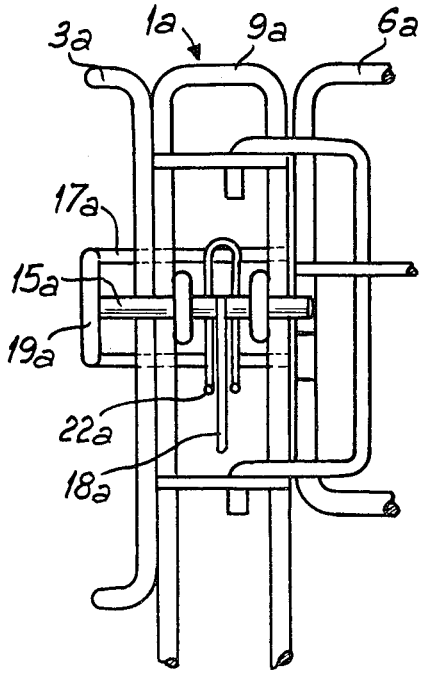
FIG. 7 is a view similar to FIG. 3 showing a modified form of embodiment of the locking device of this invention.

FIG. 7 illustrates a modified form of embodiment of the instant invention wherein a hairpin-like member **17*a* of round-sectioned metal wire is substituted for the plate 17 of the preceding example. The intermediate portion 19*a* of this wire member 17*a* constitutes a keeper engageable by the corresponding end of sliding bolt 15*a*. Besides, a modified resilient clamp 22*a* is substituted for the resilient metal clamp 22 and adapted to be engaged by the hand lever 18*a* of sliding bolt 15*a***.

However, except for these two minor changes, the design and mode of operation of the device illustrated in FIG. 7 are basically the same as those of the preceding example. Besides, the various component elements of this device and the corresponding adjacent or cooperating elements of the receptacle are designated by the same reference numerals bearing the index letter *a*.

As already explained in the foregoing, this locking device may be fitted not only to transport crates and like receptacles such as the one illustrated generally in FIG. 1, but also to carts or possible other transport devices of similar construction comprising lateral walls of which at least one comprises a folding, hingedly mounted shutter or door.

Of course, this invention concerning an improved locking device should not be construed as being strictly limited by the specific form of embodiment and variations thereof shown and described herein, since various other modifications may be brought thereto without departing from the basic principles of the invention. Thus, the lock keeper may be constructed in a different manner, possibly by being carried by the edges of the lateral walls 3 and 4 instead of by the sides of the wall 1 provided with the movable shutter 6.

On the other hand, this invention is also concerned by way of novel industrial products with goods transporting and/or handling receptacles, carts or the like, of which at least one wall comprises a folding shutter provided with one or a plurality of locking devices of the type disclosed in the foregoing.

What is claimed as new is:

1. In a goods transporting and handling cart, receptacle or the like, comprising at least one movable lateral wall and a hingedly mounted folding shutter disposed in an aperture formed in said lateral wall, a locking device comprising a sliding bolt mounted on one side of said wall, a keeper carried by the adjacent wall and adapted to be engaged by said sliding bolt in one position thereof, wherein said sliding bolt, in an intermediate position thereof, is capable of locking said movable wall, said shutter and said bolt against movement, said locking device further comprising a member for controlling said sliding bolt and a resilient clamp adapted to be engaged by, and to retain said sliding bolt in said intermediate position, said folding shutter further comprising a shoulder adapted to be engaged by the adjacent end of said sliding bolt in said intermediate position to preclude any untimely release of said shutter even in case said cart or like receptacle were turned upside down.

2. Locking device as disclosed in claim 1, wherein the length of said sliding bolt is such that in said intermediate position its ends engage the one said keeper and the other the outer surface of the adjcent edge of said folding shutter, respectively, the arrangement being such that in either of its endmost positions only one end of said sliding bolt is operative.

3. Locking device as recited in claim 2, wherein said resilient clamp adapted to be engaged by said control member of said sliding bolt in the intermediate position thereof is also capable of holding said control member in either of the endmost positions of said sliding bolt.

4. Locking device as recited in claim 3, wherein said sliding bolt keeper consists of the edge portion of a metal plate supporting on the one hand lugs for guiding said sliding bolt and on the other hand said resilient clamp for holding said control member against movement.

5. Locking device as recited in claim 4, wherein said folding shutter consists of a metal grating, and said shoulder adapted to be engaged by one of the sliding bolt ends consists of a metal wire elbow element forming an integral part of the relevant side of said shutter.

6. Goods transporting or handling receptacle, cart or the like, comprising hingedly mounted lateral walls as recited in claim 1, wherein said lateral wall is hingedly mounted.

* * * * *